United States Patent [19]

Yang

[11] Patent Number: 4,837,885

[45] Date of Patent: Jun. 13, 1989

[54] PRESTRESSED STAY CABLE FOR USE IN CABLE-STAYED BRIDGES

[75] Inventor: Y. C. Yang, San Francisco, Calif.

[73] Assignee: T.Y. Lin International, San Francisco, Calif.

[21] Appl. No.: 226,837

[22] Filed: Aug. 1, 1988

[51] Int. Cl.[4] ..... E01D 11/00

[52] U.S. Cl. ..... 14/21; 52/223 L

[58] Field of Search ..... 14/21, 22, 18, 19; 52/223 R, 223 L, 230, 231, 743, 87, 231; 156/48

[56] References Cited

U.S. PATENT DOCUMENTS

| | | | |
|---|---|---|---|
| 4,449,855 | 5/1984 | Langwadt | 52/223 R |
| 4,473,915 | 10/1984 | Finsterwalder | 14/22 |
| 4,484,425 | 11/1984 | Muller | 14/22 |
| 4,742,591 | 5/1988 | Muller | 14/19 |

FOREIGN PATENT DOCUMENTS

| | | | |
|---|---|---|---|
| 0220113 | 5/1987 | European Pat. Off. | 52/223 R |
| 2425866 | 12/1975 | Fed. Rep. of Germany | 14/22 |
| 1230559 | 9/1960 | France | 52/223 R |

*Primary Examiner*—Jerome W. Massie
*Assistant Examiner*—G. Spahn
*Attorney, Agent, or Firm*—Owen, Wickersham & Erickson

[57] ABSTRACT

A cable-stayed bridge. At least one vertical bridge tower supported by a pier is used in conjuction with a horizontal traffic-supporting deck having a cable girder beneath it and supporting it. A plurality of cable stays, are each anchored to the upper end of the tower and extend at an angle to and through the deck and are anchored to the cable girder. Each stay is prestressed and comprises an inner cable group of greased strands enclosed in an inner rigid structural pipe and an outer cable group of cemented grouted strands outside the inner pipe and enclosed by an outer rigid structural pipe. This outer rigid structural pipe surroundings the outer cable group and is separated therefrom by cement grouts. Each cable group has anchors for its extreme upper end and for its extreme lower end. Prestressing is done between the extreme ends to a desired tension.

4 Claims, 3 Drawing Sheets

FIG. 5
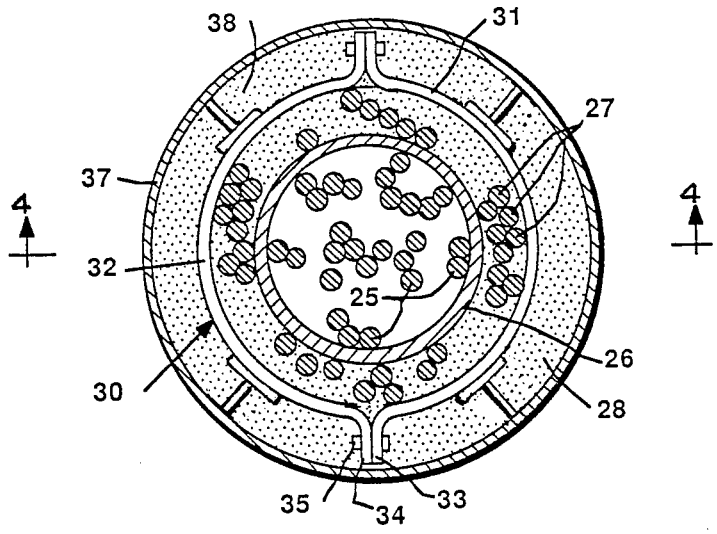
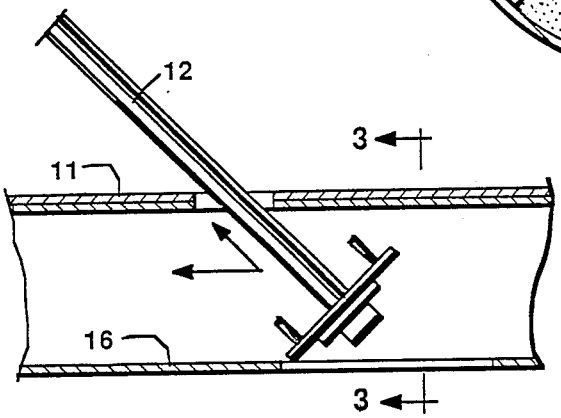
FIG. 2
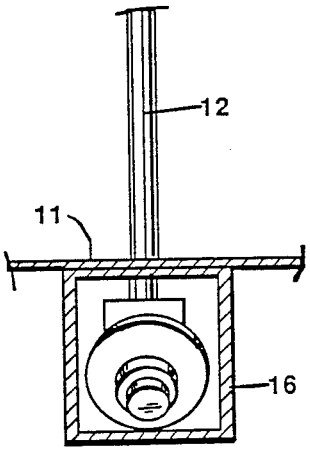
FIG. 3
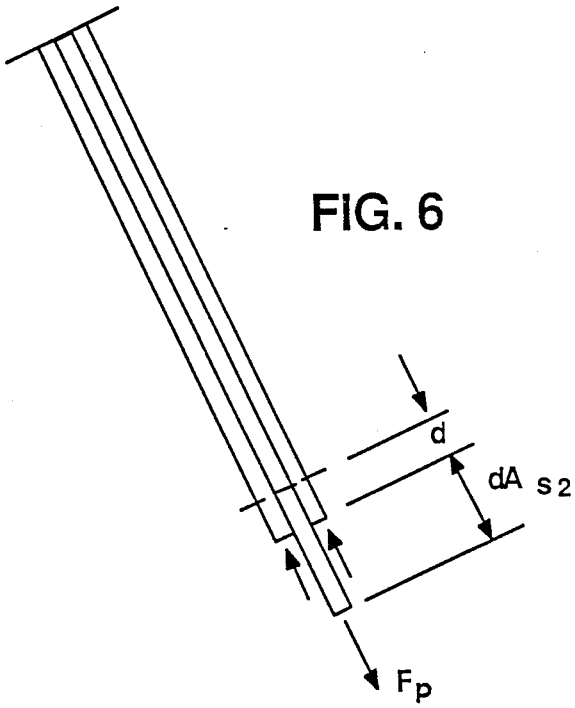
FIG. 6

PRESTRESSED STAY CABLE FOR USE IN CABLE-STAYED BRIDGES

This invention relates to a prestressed stay cable for use in cable-stayed bridges.

BACKGROUND OF THE INVENTION

Cable-stayed bridges have proven to be economical for spans in the range of 1,000 ft. They are economical because of the lightness of the bridge deck, which is supported by closely-spaced cables that are designed to carry the horizontal component of the cables, and because they reduce the amount of bending, due to their short spans. However, the lightness of the deck structure also brings with it the disadvantage of a relatively flexible deck which is less able than a stiffer structure to spread the live load over a larger area.

Because of this flexibility, the cable girder (i.e., the longitudinal girder where the bottom ends of the cables are anchored) has to be designed to be stiff enough to distribute the live loads over several cables. Thus, the smaller the differential deflection, the lighter and more economical the longitudinal cable girder will be.

Stay cables are also subject to corrosion. Although protection by cement grout within an enclosure pipe is commonly provided, there have been questions on the grout's competency in protecting the cables against corrosion, because of the grout's tendency to crack due to shrinkage and cable elongation under live loads.

OBJECTS OF THE INVENTION

An object of the invention is to reduce cable elongation and therefore the differential deflection under live loads. This is done by prestressing the composite section comprising the steel pipes, the cement grout, and the portion of cables supporting the dead load, and by stressing the cables for live loads after the dead-load cables have been stressed and the pipe grouted.

Another object is to ensure the competency of the cement grout in providing protection to the cable. This is done by keeping it always in a state of compression.

BRIEF DESCRIPTION OF THE DRAWINGS

FIG. 2 is an enlarged fragmentary view of a portion of FIG. 1.

FIG. 3 is a view in section taken along the line 3—3 in FIG. 2.

FIG. 5 is a view in cross-section of the prestressed cable of FIG. 4.

FIG. 6 is a diagrammatic view which is used in a mathematical explanation and analysis regarding the effect of the bridge, in view comprising a composite section between a top anchorage and a bottom anchorage.

DESCRIPTION OF A PREFERRED EMBODIMENT

Figure 1:
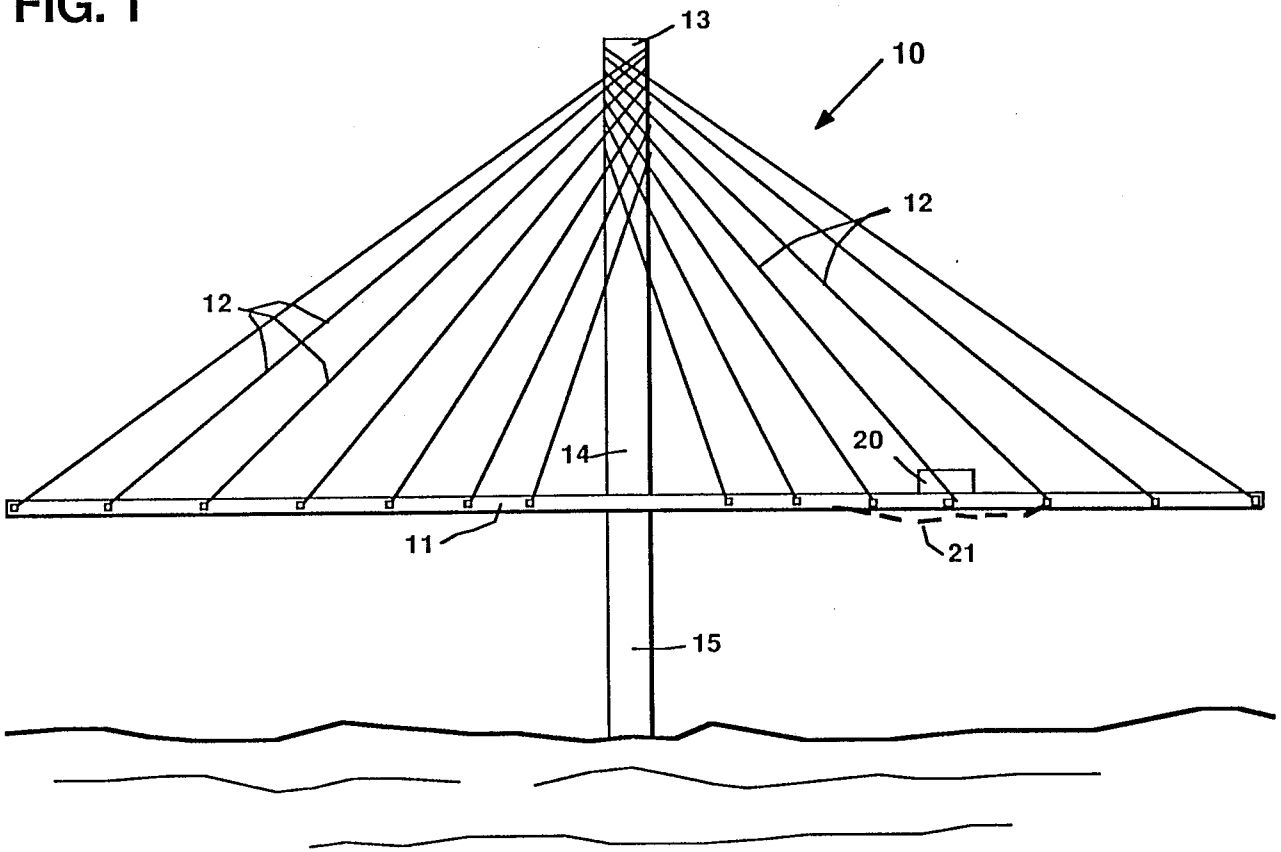
FIG. 1 is a diagrammatic view in side elevation of a cable-stayed bridge of the type embodying the principles of the present invention.

FIG. 1 shows a cable-stayed bridge 10 having a bridge deck 11 supported by cables 12 anchored to the upper end portion 13 of a pylon or tower 14. The upper end 13 serves for cable anchoring, some of the cables 12 being anchored higher up than other cables along the pylon or tower 14. The pylon or tower 14 rests upon a pier 15.

FIG. 2 shows a detail of a portion of the bridge 10 where the deck 11 and cable 12 meet, and it shows the cable 12 going below the deck 11 proper to the lower region of a cable girder 16. As shown in FIG. 3, longitudinal girder 16 may be in a box shape or some other appropriate shape, and may be of steel or concrete.

The live load of the bridge (e.g., the load of the traffic thereon) is indicated by a rectangular area 20 in FIG. 1 where the deck 11 meets the cables 12, and the differential deflection of the cable girder 16 is shown diagrammatically in FIG. 1 by a broken line 21.

Figure 4:
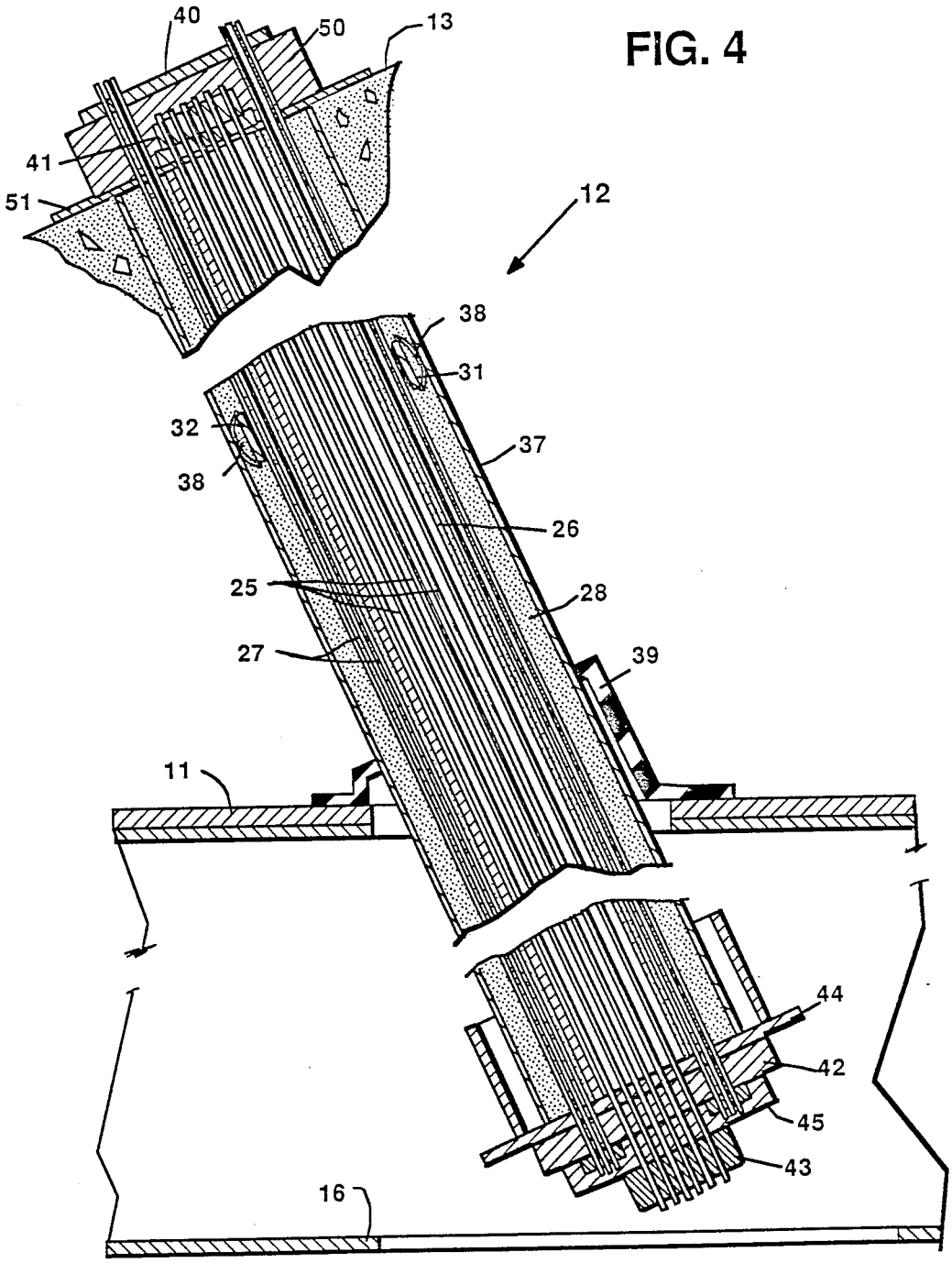
FIG. 4 is a further enlarged fragmentary view in longitudinal section of the cable of FIGS. 2 and 3, showing one way of anchoring the stay cable.

In the present invention, the cable stays 12 are prestressed. As shown in FIGS. 4 and 5, the cable 12 in each instance includes innermost greased cable strands 25, for live load, which are surrounded by an inner pipe 26 of steel with a cross-sectional area of $A_{sp2}$. It may be of polyethylene, in which case $A_{sp2}=0$. The pipe 26 is surrounded by PC grouted cable strands 27 for dead load, with grout 28. Thus, this group of the strands 27 may be called Group 1, with a cross-sectional area $=A_{s1}$, and the inner greased strands 25 may be called Group 2 with a cross-sectional area $=A_{s2}$. Around the Group 1 cables 27 is an encircling strap 30 preferably made up of two semicircular members 31 and 32 secured together by flanges 33 and 34 at each end and bolts 35. The area outside the strap 30 is also filled with grout 36, which may comprise high-strength portland cement grout (PC), and around that is an outer pipe casing 37, with a cross-sectional area $A_{sp1}$. Spacers 38 (FIG. 5) are welded to the strap 30 to keep the cable assembly in the center of the pipe casing 37. Also, seals 39 are provided when the cable 12 meets the deck 11 (FIG. 4) to keep moisture out of the longitudinal girder 16.

As shown in FIG. 4, there is a stressing anchorage 40 at the upper end 13 of the tower 14 for the cable portions $A_{s1}$ and an end anchorage 41 below that for the cables of $A_{s2}$. There is a bearing plate 50 for the anchorage 40 and a bearing plate 51 for the anchorage 41. At the lower end of the cable 12 is the longitudinal cable girder 16 below the deck 11 and in the region of the girder 16 are again an end anchorage 42 for the cable group $A_{s1}$, with a bearing plate 44 and a stressing anchorage 43 for the cable group $A_{s2}$, with a bearing plate 45. If desired the prestressing ends may be located at the ends opposite to what has been stated.

It will be assumed for the following illustrative calculations, (See also FIG. 6) that the strength of the cement grout 36 is 3,000 psi and that strands 0.6 inch in diameter are used. Each 0.6 inch cable strand has an area of 0.217 square inch, and is capable of a working stress of $0.4\times270$ ksi$=108$ ksi. This means that each cable can take a working force of $0.4\times270\times0.217$ which equals 23.4 kips.

The cable tension per dead load is assumed to be 670 kips, requiring 29 strands, so that $A_{s1}=6.3$ square inches. The cable tension per live load$=270$ k, which requires twelve strands for an area $A_{s2}$ of 2.6 square inches.

The outer steel pipe 37 using Schedule 40, 12" diameter pipe has a wall thickness $t=\frac{3}{8}$"; so $A_{sp1}=14.58$ in$^2$. The inner pipe 26 if of steel and, using Schedule 80, 6" diameter pipe has a wall thickness $t=0.342$"; so the $A_{sp2}$ is 8.4 in$^2$. The grout area is the internal area of the outer pipe 37 minus the gross cross-sectional area of the inner pipe 26 and the area of the group 1, strands $A_{s1}$, which equals $113.1-34.5-6.3=72.3$ in$^2$. The cable length of 800′ makes an angle $\alpha$ with the deck 11 of about 24° and the cable tension of $A_{s1}$ balances the dead load; there will be no deflection under the dead load condition.

The effective composite area $A_{comp}$ under $A_{s2}$ prestressing is $$A_{comp} = A_{sp1} + A_{sp2} + A_{s1} + \frac{A_c}{M}$$

where

M is the modular ratio assumed at 10, and $A_c$ is the area of the grout.

Thus, the composite area $A_{comp}$ equals $$14.6 + 8.4 + 6.3 + \frac{72.3}{10} = 36.5 \text{ in}^2.$$

The elongation of $A_{s2}$ under live load is $$\frac{\text{stress}}{E} \times \text{cable length} = \frac{.4(270 \text{ ksi})}{29 \times 10^3} \times 800 \times 12,$$

which equals 36″ which about equals $(d+dA_{s2})$ shown in FIG. 6, where d=the elastic shortening of the composite section and $dA_{s2}$ is the elongation beyond the original length.

The prestressing force in the strand group $A_{s2}$, $F_p=108$ ksi$\times 2.6=281$ kips, and the compression stress $$f_c \text{ on } A_{comp} = \frac{281}{36.5} = 7.7 \text{ ksi}$$

The elastic shortening of the composite section d is approximately $$\frac{7.7}{29 \times 10^3} \times 800 \times 12$$

which equals 2.5″ in the inclined direction.

The vertical deflection, therefore, equals $$\frac{2.5}{\sin 24°} \text{ which equals } \frac{2.5}{.4067}$$

which equals 6.15″. As comparison, the cable elongation of the stay cables without prestressing is equal to $$\frac{270^k}{6.3 + 2.6} \cdot \frac{800 \times 12}{29 \times 10^3}$$

which equals 10″, corresponding to a vertical deflection of 10/0.4067, which equals 25″.

The outer steel strands $As^1$ for the dead load and the inner strand $As^2$ for the live load may be anchored either on top of the pylon, or at the deck girder to suit the design.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A prestressed stay cable for use in cable stayed bridges, comprising:

an inner cable group of greased strands enclosed in an inner pipe, an outer cable group of cemented grouted strands outside of said inner pipe and retained by an encircling strap, and an outer rigid structural pipe surrounding said encircling strap and its said outer cable group and separated therefrom by cement grout, each said cable group having extreme ends, and anchors for each said extreme end of each said cable group, one extreme end of said inner cable group being prestressed to a desired tension of about 270 kips for live loads, and one extreme end of said outer cable group being prestressed to a desired tension of about 670 kips for dead loads.

2. The prestressed stay cable of claim 1, wherein said inner and outer pipes are of steel and said encircling strap is of steel or polyethylene.

3. A prestressed stay cable for use in cable-stayed bridges, comprising:

an inner cable group of greased strands enclosed in an inner ridge pipe, an outer cable group of cemented grouted strands outside of said inner rigid pipe and encircled by an encircling strap, and an outer rigid pipe surrounding said encircling strap and its encircled onto cable group and separated therefrom by cement grout, each said cable group having extreme ends, anchors for each said extreme end of each said cable group, and prestressing means for tensioning said inner cable group at one extreme end thereof.

4. A cable-stayed bridge, including in combination:

at least one vertical bridge tower having an upper end and a lower end, a pier supporting said lower end, a traffic-supporting deck extending horizontally above said lower end and below said upper end and extending adjacent and perpendicular to said tower, a cable girder beneath said deck and supporting said deck, a plurality of prestressed stay cables including an inner cable group of greased strands enclosed in an inner rigid structural pipe, an outer cable group of cemented grouted strands outside of said inner pipe and encircled by an encircling strap, an outer structural pipe spaced from said outer cable group, said outer rigid structural pipe surrounding said outer cable group being separated therefrom by cement grout, each said cable group having extreme ends, and one anchor for each said cable group in said extreme upper end of each said group and one prestressing means for each of said cable groups on each said extreme lower end, said prestressing means being secured to the extreme lower end of said inner group for prestressing said cable to a desired tension of about 280 kips, each stay cable anchored to said upper end of a said tower, each stay cable extending at an angle to said deck and through said deck and anchored to said cable girder, and prestressing means for each said cable stay located at the top of the tower and an additional prestressing means adjacent to said cable girder at the bottom.

* * * * *